US011268509B2

(12) United States Patent
Cuneo

(10) Patent No.: US 11,268,509 B2
(45) Date of Patent: Mar. 8, 2022

(54) VARIABLE DISPLACEMENT LUBRICANT VANE PUMP

(71) Applicant: PIERBURG PUMP TECHNOLOGY GMBH, Neuss (DE)

(72) Inventor: Carmine Cuneo, Pisa (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 95 days.

(21) Appl. No.: 16/635,558

(22) PCT Filed: Aug. 3, 2017

(86) PCT No.: PCT/EP2017/069693
§ 371 (c)(1),
(2) Date: Jan. 31, 2020

(87) PCT Pub. No.: WO2019/024997
PCT Pub. Date: Feb. 7, 2019

(65) Prior Publication Data

US 2020/0256335 A1 Aug. 13, 2020

(51) Int. Cl.
*F03C 2/00* (2006.01)
*F03C 4/00* (2006.01)
(Continued)

(52) U.S. Cl.
CPC ..... *F04C 14/226* (2013.01); *F01C 21/10* (2013.01); *F04C 2/3442* (2013.01); *F04C 2210/14* (2013.01); *F04C 2240/809* (2013.01)

(58) Field of Classification Search
CPC .... F04C 2/3442; F04C 14/223; F04C 14/226; F04C 2210/14; F04C 2240/809;
(Continued)

(56) References Cited

U.S. PATENT DOCUMENTS

2008/0038117 A1* 2/2008 Armenio ..... F04C 14/223 418/24
2009/0022612 A1 1/2009 Williamson et al.
(Continued)

FOREIGN PATENT DOCUMENTS

CN 101892981 A 11/2010
CN 105264230 A 1/2016
(Continued)

*Primary Examiner* — Theresa Trieu
(74) *Attorney, Agent, or Firm* — Norman B. Thot

(57) ABSTRACT

A variable lubricant vane pump includes a pump housing, a shiftable control ring, a rotatable pump rotor, a control ring preload spring which preloads and pushes the control ring into a high eccentricity direction, a hydraulic safety control chamber which moves the control ring against the control ring preload spring and which is directly and constantly pressurized with a pressurized lubricant having a pump outlet pressure, a separate hydraulic adjustment control chamber which moves the control ring against the control ring preload spring and which is selectively pressurized with the pressurized lubricant having an over-atmospheric pressure, an electric adjustment valve which selectively directs the pressurized lubricant having the over-atmospheric pressure to the separate hydraulic adjustment control chamber, and a calibrated hydraulic channel which directly connects the separate hydraulic adjustment control chamber with atmospheric pressure. An effective hydraulic cross-sectional area of the calibrated hydraulic channel is less than 5.0 mm$^2$.

11 Claims, 2 Drawing Sheets

(51) Int. Cl.

| | |
|---|---|
| ***F04C 2/00*** | (2006.01) |
| ***F04C 18/00*** | (2006.01) |
| ***F04C 14/22*** | (2006.01) |
| ***F04C 2/344*** | (2006.01) |
| ***F01C 21/10*** | (2006.01) |

(58) Field of Classification Search
CPC ..... F04C 2270/22; F04C 2270/225; F01C 21/0836; F01C 21/10; F01M 1/02; F01M 1/16
See application file for complete search history.

(56) References Cited

U.S. PATENT DOCUMENTS

| | | | |
|---|---|---|---|
| 2010/0221126 | A1 | 9/2010 | Tanasuca et al. |
| 2012/0138011 | A1 | 6/2012 | Maccarrone |
| 2014/0030120 | A1* | 1/2014 | Cuneo ..... F04C 14/223 418/24 |
| 2016/0115832 | A1 | 4/2016 | Celata et al. |
| 2016/0290335 | A1 | 10/2016 | Cuneo et al. |

FOREIGN PATENT DOCUMENTS

| | | | |
|---|---|---|---|
| GB | 2486017 | A | 6/2012 |
| WO | WO 2006/066405 | A1 | 6/2006 |
| WO | WO 2007/087704 | A1 | 8/2007 |
| WO | WO 2014/187503 | A1 | 11/2014 |
| WO | WO 2015/074700 | A1 | 5/2015 |

* cited by examiner

VARIABLE DISPLACEMENT LUBRICANT VANE PUMP

CROSS REFERENCE TO PRIOR APPLICATIONS

This application is a U.S. National Phase application under 35 U.S.C. § 371 of International Application No. PCT/EP2017/069693, filed on Aug. 3, 2017. The International Application was published in English on Feb. 7, 2019 as WO 2019/024997 A1 under PCT Article 21(2).

FIELD

The present invention relates to a mechanical variable displacement lubricant vane pump for providing a pressurized lubricant having a positive pump outlet pressure for lubricating an internal combustion engine.

BACKGROUND

A mechanical lubricant vane pump is mechanically driven by an engine, for example, via a gear or a belt, and is fluidically coupled to the combustion engine for pumping the pressurized lubricant having the pump outlet pressure to and through the engine. The pump outlet pressure or the gallery pressure of the lubricant in the engine or at the lubricant outlet of the engine needs to be controlled and stabilized to a set pressure value.

WO 2015 113 437 A1 describes a typical variable displacement lubricant vane pump which is part of a lubrication circuit which also comprises an internal combustion engine and a complex hydraulic control valve for controlling the set pump outlet pressure. The lubricant vane pump is provided with a static pump housing, a shiftable control ring, and a rotatable pump rotor comprising several rotor vanes which rotate within the shiftable control ring. The control ring is shiftable with respect to the pump rotor to thereby vary the eccentricity of the control ring with respect to the pump rotor for controlling the displacement and, as a result, the volumetric pump performance of the pump.

The pump is provided with a control ring preload spring which preloads and pushes the shiftable control ring into the high eccentricity direction. The pump is further provided with a control chamber which is loaded with the pump outlet pressure and which causes the shiftable control ring to move into the low eccentricity direction against the control ring preload spring. The pump is also provided with a complex control valve which allows different set pump outlet pressures to be chosen.

WO 2014 187 503 A1 describes a variable displacement lubricant vane pump as part of a lubrication circuit wherein the set pressure of the pump is the gallery pressure of the engine.

SUMMARY

An aspect of the present invention is to provide a simple variable displacement lubricant vane pump which allows different set lubricant pressures to be provided.

In an embodiment, the present invention provides a variable lubricant vane pump for providing a pressurized lubricant with a pump outlet pressure. The variable lubricant vane pump includes a static pump housing, a control ring configured to be shiftable, a pump rotor configured to rotate, a control ring preload spring which is configured to preload and to push the control ring into a high eccentricity direction, a hydraulic safety control chamber which is configured to cause the control ring to move against the control ring preload spring and which is directly and constantly pressurized with the pressurized lubricant having the pump outlet pressure, a separate hydraulic adjustment control chamber which is configured to cause the control ring to move against the control ring preload spring and which is selectively pressurized with the pressurized lubricant having an over-atmospheric pressure, an electric adjustment valve which is configured to selectively direct the pressurized lubricant having the over-atmospheric pressure to the separate hydraulic adjustment control chamber, and a calibrated hydraulic channel which is configured to directly connect the separate hydraulic adjustment control chamber with atmospheric pressure. An effective hydraulic cross-sectional area of the calibrated hydraulic channel is less than 5.0 $mm^2$. The pump rotor comprises a plurality of rotor vanes which are configured to rotate within the control ring. The control ring is configured to be shiftable with respect to the pump rotor to vary an eccentricity of the control ring with respect to the pump rotor so as to control a volumetric pump performance.

BRIEF DESCRIPTION OF THE DRAWINGS

The present invention is described in greater detail below on the basis of embodiments and of the drawings in which.

DETAILED DESCRIPTION

Figure 1:
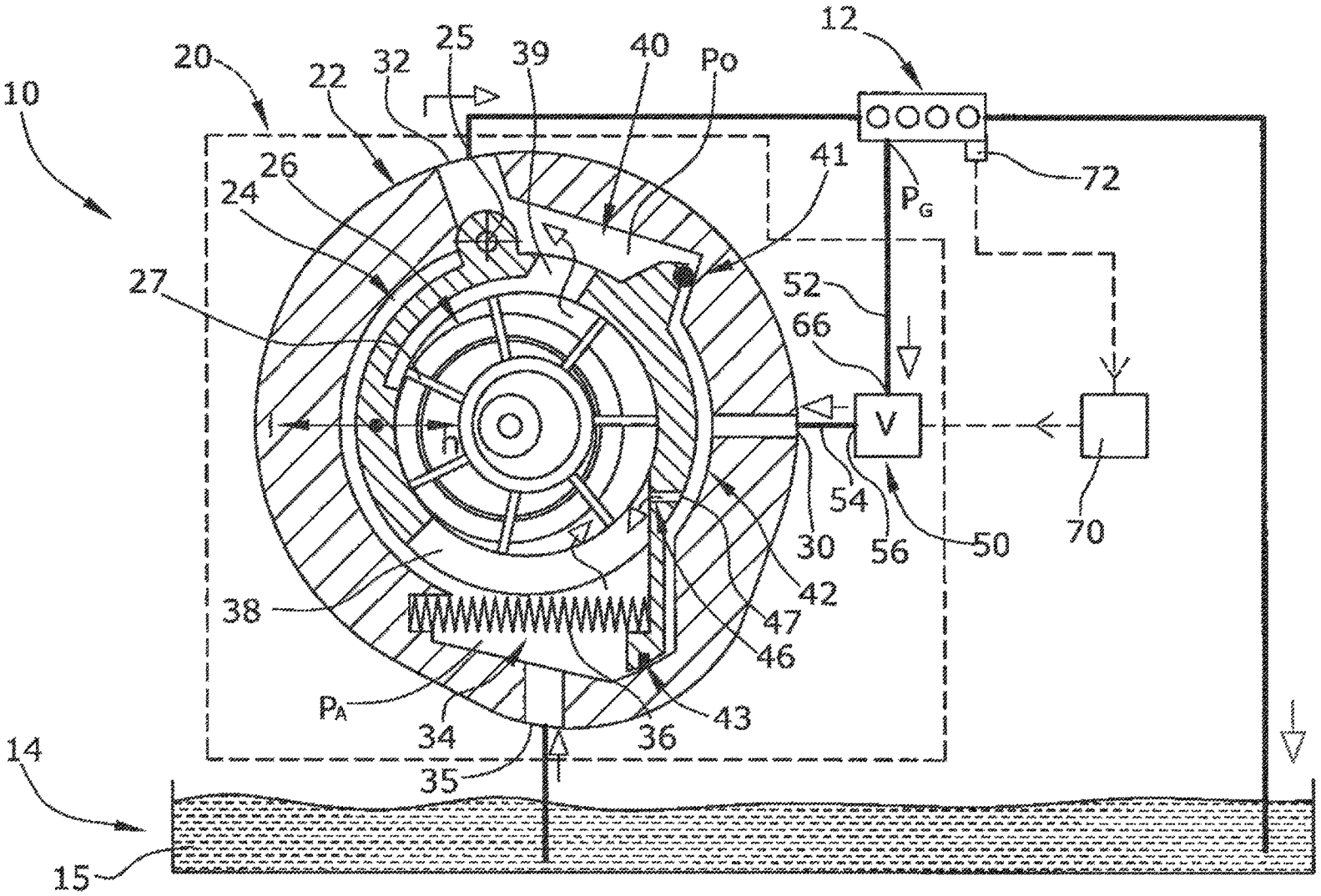
FIG. 1 schematically shows an automotive lubrication circuit with a variable displacement lubricant vane pump, an electric adjustment valve, and an internal combustion engine which is provided with a pressurized lubricant which is generated by the vane pump.

The variable displacement lubricant vane pump is provided with a static pump housing surrounding a pumping chamber wherein a shiftable control ring is provided. The shiftable control ring can be supported at the housing to be shiftable in a strictly linear direction or to be pivotable so that the control ring is shifted along an arch-like path. A rotatable pump rotor is arranged within the control ring. The pump rotor comprises several rotor vanes rotating within the control ring which separate the pumping chamber into several rotating pumping chamber compartments. The vane pump can be a classical vane pump or, alternatively, can be a pendulum vane pump. The rotation axis of the pump rotor is static so that the shifting of the control ring changes the eccentricity of the control ring with respect to the pump rotor to thereby control the pump's displacement and the pump's volumetric performance.

A control ring preload spring is provided for preloading and pushing the shiftable control ring into the high eccentricity position, which is the position in which the pump has the highest displacement and volumetric performance in reference to a constant rotational speed.

The pump is provided with a hydraulic safety control chamber which causes the shiftable control ring to move against the control ring preload spring into the low eccentricity position. The safety control chamber is directly and constantly loaded and pressurized with the lubricant having the pump outlet pressure. The safety control chamber can be hydraulically directly connected to or can even be a part of an internal outlet cavity of the pump where the pressurized lubricant leaving the pumping chamber compartment is accumulated and from where the pressurized lubricant flows to the pump outlet.

After the combustion engine driving the pump rotor has been started, the pressurized lubricant generated by the pump immediately and directly loads the safety control chamber so that a minimum basic control of the pump outlet pressure is realized. This provides that an over-pressure of the lubricant leaving the pump at the pump outlet can reliably be avoided even at the very beginning of the engine's run and the pump's run.

The pump is provided with a separate hydraulic adjustment control chamber which is responsible for the precise pressure control of the pump. The adjustment control chamber causes the shiftable control ring to move against the control ring preload spring into the low eccentricity direction so that the adjustment control chamber cooperates with the safety control chamber into the same direction.

The adjustment control chamber is selectively pressurized with pressurized lubricant having a pressure which exceeds atmospheric pressure. The adjustment control chamber is selectively pressurized via an electric adjustment valve which can, for example, be provided as a switching valve or, alternatively, as a proportional valve. The electric adjustment valve is simply a two-way valve with a single hydraulic inlet and a single hydraulic outlet. The adjustment valve is not provided with any additional hydraulic input or output.

The pressurized lubricant which is selectively directed to the adjustment control chamber via the adjustment valve can, for example, be the lubricant having the engine's gallery pressure. The engine's gallery pressure is thereby the set pressure parameter of the pump if the electric adjustment valve is at least open in part so that the pressurized lubricant loads the adjustment control chamber.

The adjustment control chamber is additionally always hydraulically connected to atmospheric pressure via a calibrated hydraulic channel which directly connects the adjustment control chamber with atmospheric pressure, for example, connected with a pump inlet chamber where lubricant of atmospheric pressure is always present.

If the electric adjustment valve is completely closed, the adjustment control chamber is pressurized with atmospheric pressure so that substantially only the safety control chamber generates a force against the control ring preload spring. The hydraulic adjustment control chamber is more or less pressurized with over-atmospheric pressure if the electric adjustment valve is completely or partly opened. The resulting over-atmospheric pressure in the control chamber then depends on the absolute pressure of the lubricant upstream of the adjustment valve and on the effective hydraulic cross-section area of the calibrated hydraulic channel. The effective hydraulic cross-section area of the calibrated hydraulic channel is less than 5.0 $mm^2$, which is a relatively small cross-section area. The calibrated hydraulic channel has a substantial hydraulic resistance if the electric adjustment valve is completely open.

The electric adjustment valve can, for example, be provided with a valve body which is preloaded by a valve preload spring into the closed valve position. In the closed valve position, the hydraulic adjustment control chamber is pressurized with atmospheric pressure (via the calibrated hydraulic channel) so that only the safety control chamber is an active part of the pressure control circuit. Should the electromagnetic part of the electric adjustment valve fail, a minimum closed-loop control circuit is remains working to keep and limit the set pressure at a maximum value.

In an embodiment of the present invention, the valve body can, for example, be provided with a counter acting surface which is loaded with the pressurized lubricant of over-atmospheric pressure to push the valve body into the open valve body position against the valve preload spring. The electric adjustment valve is a proportional valve which keeps the set pressure value, for example, the gallery pressure at the engine, at a more or less constant level.

In an embodiment of the present invention, the electric adjustment valve can, for example, be provided with a valve inlet which is connectable to the lubricant gallery pressure of the internal combustion engine. The internal combustion engine is supplied with the pressurized lubricant coming from the pump outlet and having and the pump outlet pressure. In other words, the set pressure parameter is the combustion engine's gallery pressure, not the pump outlet pressure.

In an embodiment of the present invention, the calibrated hydraulic channel can, for example, directly connect the adjustment control chamber with a pump inlet chamber. The pump inlet chamber is directly fluidically connected with the hydraulic pump inlet and is filled with the lubricant having atmospheric pressure.

The lubrication circuit according to the present invention comprises the variable displacement lubricant vane pump, an internal combustion engine which is hydraulically connected to a pump outlet of the lubricant vane pump, and an electronic pump controller which electrically controls the electric adjustment valve. A lubricant temperature sensor can additionally be provided which is electrically or electronically connected to the pump controller. The pump controller then controls the electric adjustment valve dependent on the lubricant temperature provided by the lubricant temperature sensor. If the lubricant temperature is relatively low, the set pressure is reduced accordingly to avoid a damage of the lubrication circuit.

An embodiment of the present invention is described in detail below under reference to the drawings.

FIG. 1 schematically shows an engine lubrication circuit 10 with a variable displacement lubricant vane pump 20, an internal combustion engine 12, a lubricant tank 14, and a pump controller 70.

The lubricant vane pump 20 is mechanically driven by the internal combustion engine 12, for example, via a belt or a gear (which are not shown in the drawings).

The lubricant vane pump 20 is provided with a pump inlet 35 through which the liquid lubricant 15 in the lubricant tank 14 is sucked into a pump inlet chamber 34, and with a pump outlet 32 from where the pressurized lubricant flows to the internal combustion engine 12 for lubrication of the internal combustion engine 12. The pressure of the liquid lubricant 15 in the lubricant tank 14 and in the pump inlet chamber 34 is substantially atmospheric pressure $P_A$.

The lubricant vane pump 20 is provided with a static pump housing 22, a shiftable control ring 24, and a rotatable pump rotor 26 comprising seven rotor vanes 27 which are arranged to be radially slidable in a non-slidable pump rotor body. The rotation axis of the pump rotor 26 is static. The shiftable control ring 24 in this embodiment is arranged to pivot around a pivot axis 25, but can alternatively be arranged as a control ring which is shiftable exactly linearly.

The shiftable control ring 24 encloses a pumping chamber which is divided by the rotor vanes 27 into seven rotating pumping chamber compartments. The shiftable control ring 24 is shiftable into a low eccentricity direction 1, in which the eccentricity between the shiftable control ring 24 and the pump rotor 26 becomes relatively small, or into a high eccentricity direction h, in which the eccentricity between the shiftable control ring 24 and the pump rotor 26 becomes relatively high.

The shiftable control ring 24 is provided with a chamber inlet recess 38 through which the lubricant of atmospheric pressure $P_A$ is sucked into the pumping chamber and into the pumping chamber compartments. A chamber outlet recess 39 is provided opposite to the chamber inlet recess 38 in the shiftable control ring 24. Lubricant with a pump outlet pressure $P_O$ is directed through the chamber outlet recess 39 to the pump outlet 32.

The shiftable control ring 24 is preloaded by a control ring preload spring 36 into the high eccentricity direction h so that, if no other forces in the two shifting directions are effective with respect to the shiftable control ring 24, the shiftable control ring 24 is pushed into the maximum eccentricity position.

A hydraulic safety control chamber 40 is provided adjacent to the pivot axis 25. The safety control chamber 40 is directly pressurized with the lubricant having the pump outlet pressure $P_O$ and is hydraulically directly connected with the chamber outlet recess 39. As a result, the safety control chamber 40 is pressurized with the pump outlet pressure $P_O$ immediately after the lubricant vane pump 20 has started delivering pressurized lubricant. A basic hydraulic closed-loop control circuit is consequently ready and effective as soon as pressurized lubricant is generated by the lubricant vane pump 20.

A separate hydraulic adjustment control chamber 42 is provided circumferentially between the safety control chamber 40 and the pump inlet chamber 34. The hydraulic separation of the safety control chamber 40 and the adjustment control chamber 42 is realized by a first sliding sealing arrangement 41, and the hydraulic separation of the adjustment control chamber 42 and the pump inlet chamber 34 is realized by a second sliding sealing arrangement 43.

The adjustment control chamber 42 is fluidically connected to the pump inlet chamber 34 by a calibrated hydraulic channel 46 directly connecting the adjustment control chamber 42 with the atmospheric pressure $P_A$ in the pump inlet chamber 34. The calibrated hydraulic channel 46 is realized as a bore 47 in the shiftable control ring 24 with a constant cross-sectional area of about 3.0 $mm^2$.

Figure 2:
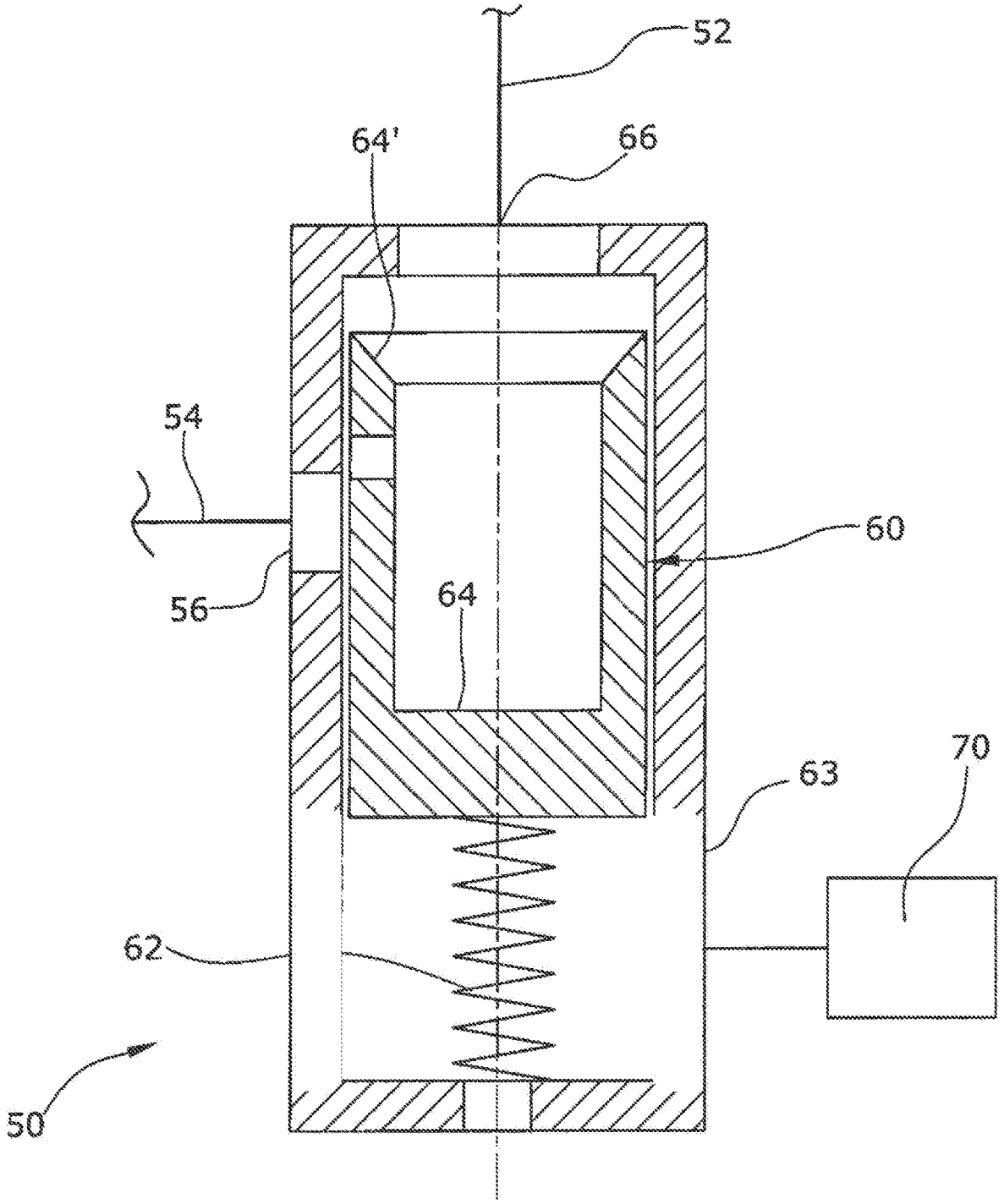
FIG. 2 shows the electric adjustment valve of FIG. 1 in detail.

The lubricant vane pump 20 is provided with an electric adjustment valve 50 for selectively directing pressurized lubricant to the adjustment control chamber 42. The electric adjustment valve 50 is, as is shown in greater detail in the embodiment of FIG. 2, is provided as a proportional valve.

The electric adjustment valve 50 is a simple two-way valve with an axial valve inlet 66 which is hydraulically connected to the gallery pressure $P_G$ of the internal combustion engine 12 via a hydraulic gallery pressure line 52, and with a radial valve outlet 56 which is hydraulically connected via a hydraulic control line 54 to a hydraulic adjustment control chamber access 30 of the static pump housing 22. The hydraulic adjustment control chamber access 30 is hydraulically directly connected to the adjustment control chamber 42.

The electric adjustment valve 50 is provided with a shiftable ferromagnetic valve body 60 which is axially preloaded into a closed valve position by a valve preload spring 62. The valve body 60 is loaded with the lubricant's gallery pressure $P_G$ which is hydraulically effective at the hydraulic counter acting surfaces 64, 64'. The gallery pressure $P_G$ is generally of over-atmospheric pressure and thereby generates a force against the spring force of the valve preload spring 62. If the gallery pressure $P_G$ is high enough to compensate the spring force of the valve preload spring 62, the valve body 60 is shifted into the opening direction or into a total open valve body position.

The electric adjustment valve 50 is also provided with an electromagnet 63 which can be energized by the pump controller 70 to thereby generate an opening force acting against the closing force of the valve preload spring 62 to thereby reduce the total closing force acting on the valve body 60.

A lubricant temperature sensor 72 is provided at the internal combustion engine 12 to generate a temperature signal which is received by the pump controller 70. The pump controller 70 controls and determines the set gallery pressure dependent on the measured lubricant temperature. If the measured lubricant temperature is relatively low, the pumping performance of the lubricant vane pump 20 is reduced by energizing the valve's electromagnet 63 so that the shiftable control ring 24 is pushed more into the low eccentricity direction 1. If the lubricant temperature is relatively high, the volumetric pumping performance is increased by the pump controller 70 by reducing the electric energy driving the electromagnet 63.

If the electric adjustment valve 50 is completely closed, the lubricant in the adjustment control chamber 42 has the same atmospheric pressure $P_A$ which is present in the pump inlet chamber 34 because the pump inlet chamber is hydraulically connected to the hydraulic adjustment control chamber 42 via the calibrated hydraulic channel 46. If the electric adjustment valve 50 is completely in the hydraulic open position, the adjustment control chamber 42 is substantially pressurized with the gallery pressure $P_G$. For that case, the cross-sectional area of the calibrated hydraulic channel 46 is so small that most of the pressure difference between the gallery pressure $P_G$ and the atmospheric pressure $P_A$ is not reduced by the calibrated hydraulic channel 46.

If the electric adjustment valve 50 should fail electrically, the electric adjustment valve 50 hydraulically still works and controls the set gallery pressure at the maximum value. If the electric adjustment valve 50 should fail hydraulically, the safety control chamber 40 still provides that no extreme lubricant outlet pressures $P_O$ can appear.

The present invention is not limited to embodiments described herein; reference should be had to the appended claims.

What is claimed is:

1. A variable lubricant vane pump for providing a pressurized lubricant with a pump outlet pressure, the variable lubricant vane pump comprising:

a pump inlet;

a static pump housing;

a control ring configured to be shiftable;

a pump rotor configured to rotate, the pump rotor comprising a plurality of rotor vanes which are configured to rotate within the control ring, the control ring being configured to be shiftable with respect to the pump rotor to vary an eccentricity of the control ring with respect to the pump rotor so as to control a volumetric pump performance;

a control ring preload spring which is configured to preload and to push the control ring into a high eccentricity direction;

a hydraulic safety control chamber which is configured to cause the control ring to move against the control ring preload spring and which is directly and constantly pressurized with the pressurized lubricant having the pump outlet pressure;

a separate hydraulic adjustment control chamber which is configured to cause the control ring to move against the control ring preload spring and which is selectively pressurized with the pressurized lubricant having an over-atmospheric pressure;

an electric adjustment valve which selectively directs the pressurized lubricant having the over-atmospheric pressure to the separate hydraulic adjustment control chamber; and a calibrated hydraulic channel which always directly connects the separate hydraulic adjustment control chamber with atmospheric pressure via the pump inlet, an effective hydraulic cross-sectional area of the calibrated hydraulic channel being less than 5.0 $mm^2$.

2. The variable lubricant vane pump as recited in claim 1, wherein the separate hydraulic adjustment control chamber is selectively pressurized via the electric adjustment valve with the pressurized lubricant having a gallery pressure of an internal combustion engine.

3. The variable lubricant vane pump as recited in claim 1, wherein the electric adjustment valve is a switching valve.

4. The variable lubricant vane pump as recited in claim 1, wherein the electric adjustment valve is a proportional valve.

5. The variable lubricant vane pump as recited in claim 1, wherein, the electric adjustment valve comprises a valve body and a valve preload spring, and the valve preload spring is configured to preload the valve body into a closed valve body position.

6. The variable lubricant vane pump as recited in claim 5, wherein the valve body comprises a counter acting surface which is configured to be loaded with the pressurized lubricant having the over-atmospheric pressure so as to push the valve body into an open valve body position against the valve preload spring.

7. The variable lubricant vane pump as recited in claim 5, further comprising:

a pump outlet, wherein, the electric adjustment valve further comprises a valve inlet which is connectable to a lubricant gallery pressure of an internal combustion engine which is supplied with the pressurized lubricant coming from the pump outlet and which has the pump outlet pressure.

8. A lubrication circuit comprising:

the variable lubricant vane pump as recited in claim 7;

an internal combustion engine which is hydraulically connected to the pump outlet; and a pump controller which is configured to control the electric adjustment valve.

9. The lubrication circuit as recited in claim 8, further comprising:

a lubricant temperature sensor which is connected to the pump controller, the lubricant temperature sensor being configured to measure a lubricant temperature, wherein, the pump controller is configured to control the electric adjustment valve dependent on the lubricant temperature measured by the lubricant temperature sensor.

10. The variable lubricant vane pump as recited in claim 1, further comprising:

a pump inlet chamber, wherein, the calibrated hydraulic channel is further configured to connect the separate hydraulic adjustment control chamber with the pump inlet chamber.

11. A variable lubricant vane pump for providing a pressurized lubricant with a pump outlet pressure, the variable lubricant vane pump comprising:

a pump inlet;

a static pump housing;

a control ring configured to be shiftable;

a pump rotor configured to rotate, the pump rotor comprising a plurality of rotor vanes which are configured to rotate within the control ring, the control ring being configured to be shiftable with respect to the pump rotor to vary an eccentricity of the control ring with respect to the pump rotor so as to control a volumetric pump performance;

a control ring preload spring which is configured to preload and to push the control ring into a high eccentricity direction;

a hydraulic safety control chamber which is configured to cause the control ring to move against the control ring preload spring and which is directly and constantly pressurized with the pressurized lubricant having the pump outlet pressure;

a separate hydraulic adjustment control chamber which is configured to cause the control ring to move against the control ring preload spring and which is selectively pressurized with the pressurized lubricant having an over-atmospheric pressure;

an electric adjustment valve which selectively directs the pressurized lubricant having the over-atmospheric pressure to the separate hydraulic adjustment control chamber;

a calibrated hydraulic channel which always directly connects the separate hydraulic adjustment control chamber with atmospheric pressure via the pump inlet, an effective hydraulic cross-sectional area of the calibrated hydraulic channel being less than 5.0 $mm^2$;

a pump outlet; and a pump inlet chamber, wherein, the electric adjustment valve further comprises a valve inlet which is connectable to a lubricant gallery pressure of an internal combustion engine which is supplied with the pressurized lubricant coming from the pump outlet and which has the pump outlet pressure, and the calibrated hydraulic channel is further configured to connect the separate hydraulic adjustment control chamber with the pump inlet chamber.

* * * * *